US007710237B2

(12) United States Patent
Kato

(10) Patent No.: US 7,710,237 B2
(45) Date of Patent: May 4, 2010

(54) SLIDING OPERATING DEVICE

(75) Inventor: Kojiro Kato, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 650 days.

(21) Appl. No.: 11/707,507

(22) Filed: Feb. 16, 2007

(65) Prior Publication Data

US 2007/0193849 A1 Aug. 23, 2007

(30) Foreign Application Priority Data

Feb. 22, 2006 (JP) ..... 2006-044915

(51) Int. Cl.
*H01C 10/30* (2006.01)

(52) U.S. Cl. ..... 338/160; 338/68; 338/74; 200/329; 200/252

(58) Field of Classification Search ..... 338/160–161, 338/68, 74, 202, 328; 200/329, 293, 252, 200/547
See application file for complete search history.

(56) References Cited

U.S. PATENT DOCUMENTS 4,369,424 A * 1/1983 Miyamoto ..... 338/161
4,886,946 A * 12/1989 Franks, Jr. ..... 200/329
5,673,015 A * 9/1997 Imamura et al. ..... 338/176
5,860,515 A * 1/1999 Tomotoshi ..... 200/550
5,875,884 A * 3/1999 Tomotoshi ..... 200/252
6,198,380 B1 * 3/2001 Castellano-Aldave ..... 338/176

FOREIGN PATENT DOCUMENTS

| | | |
|---|---|---|
| GB | 2 298 317 A | 8/1996 |
| GB | 2 308 506 A | 6/1997 |
| GB | 2 308 507 A | 6/1997 |
| JP | 8-236316 | 9/1996 |
| JP | 8-236317 | 9/1996 |
| JP | 8-236318 | 9/1996 |

* cited by examiner

*Primary Examiner*—Kyung Lee
(74) *Attorney, Agent, or Firm*—Morrison & Foerster LLP

(57) ABSTRACT

A case includes first and second halves, each having an opening in its one side, combined together with the openings opposed to each other. A moving member is accommodated within the case and slidingly movable along a movement guide. An operator is connected to the moving member. The operator has a proximal end connected to the moving member, a free end projecting outwardly from an upper surface of the case, and a bent portion bent between the both ends. Tops of the first and second halves are displaced from each other, in a direction vertical to the upper surface, to form a gap permitting entry of the operator. Edge regions of the tops of the both halves overlap with each other in the direction vertical to the upper surface, and the bent portion is bent so that the free end projects outwardly through the gap in the overlapping regions.

8 Claims, 6 Drawing Sheets

SLIDING OPERATING DEVICE

BACKGROUND OF THE INVENTION

The present invention relates to a sliding operating device which can be suitably used to set a parameter or the like, corresponding to user's operation, by moving an operating-position setting section (moving member) in response to operation of a sliding-type operator and detecting a position of the operating-position setting section.

Examples of the conventionally-known sliding operating devices for use in mixing consoles etc. include the one disclosed in Japanese Patent No. 3273422. The disclosed sliding operating device integrally includes a lever having a knob portion and a slider holder for holding slider pieces opposed to a resistor board. The lever and slider holder are slidably supported on guide shafts. Through manual operation of the knob portion or through driving by a motor, the slider holder moves so that a parameter or the like is set in accordance with a position of the slider pieces relative to the resistor board.

Further, in the sliding operating device disclosed in the No. 3273422 patent, one side of a motor drive unit is superposed on one cover half, the other side of the motor drive unit is superposed on the other cover half, and the two cover halves are secured together by means of screws. In such a state, the resistor board and almost all component parts of the motor drive unit are accommodated within the two cover halves, but the knob portion of the lever and guide hole of the lever project through an upper end gap of the two cover halves. Blindfold plate is inserted in the guide hole to cover the upper end gap of the two cover halves, and holders are screwed to left and right side surfaces of the cover halves so that the blindfold plate is fixed at its opposite ends to the holders.

With the conventionally-known sliding operating devices, the knob portion to be moved by a human operator projects beyond a console panel, and thus, it is absolutely necessary to form grooves in the upper surface of the sliding operating device and console panel surface along the moving direction of the knob portion. Thus, there is a need to take some anti-dust measures so that interior mechanisms and detection accuracy of the device are not influenced even when dust enters through the grooves.

With the arrangements disclosed in the No. 3273422 patent, it is possible to prevent dust, having entered through the grooves, from directly falling onto the motor drive unit; however, if dust accumulates in the interior, there is a possibility of the detection accuracy etc. being influenced. Further, with the disclosed arrangements, the guide hole must be formed in the lever to permit passage of the blindfold plate, and thus, if dust accumulates between the guide hole and the blindfold plate, sliding operability of the device would be adversely influenced. Further, the disclosed device presents the problems that the lever, requiring formation of the guide hole, and the mechanism composed of the lever and blindfold plate tend to be complicated in construction, so that the operability would suffer from aged deterioration and the necessary cost would increase.

SUMMARY OF THE INVENTION

In view of the foregoing, it is an object of the present invention to provide an improved sliding operating device which achieves reliable dust prevention with a simple construction and at reduced cost.

In order to accomplish the above-mentioned object, the present invention provides an improved sliding operating device, which comprises: a case including first and second case halves, each having an opening in one side thereof, combined together with the openings opposed to each other; a movement guide section accommodated within the case; a moving member accommodated within the case and slidingly movable along the movement guide section; and an operating section connected to the moving member, the operating section having a proximal end portion connected to the moving member, a free end portion projecting outwardly from an upper surface of the case, and a bent portion bent between the proximal end portion and the free end portion. In the upper surface area of the case, a top plate portion of the first case half and a top plate portion of the second case half are displaced from each other, in a direction vertical to the upper surface of the case, to form a gap permitting entry of the operating section. At least edge regions of the top plate portion of the first case half and the top plate portion of the second case half overlap with each other in the direction vertical to the upper surface of the case, and the bent portion of the operating section is bent so that the free end portion projects outwardly through the gap in overlapping edge regions of the top plate portions of the first case half and the second case half.

According to the present invention, the top plate portions of the first case half and second case half are displaced from each other, in the direction vertical to the upper surface of the case, in an upper surface area of the case, and at least the respective edge regions of the top plate portions of the first and second case halves overlap with each other in the direction vertical to the upper surface of the case. Even where the top plate portions have mutually-overlapping edge regions like this, the free end portion of the operating section having the intermediate bent portion can be projected outwardly of the case through the gap in the overlapping regions. The free end portion of the operating section is projected or exposed outwardly from the edge region of one of the top plate portions located outwardly of the other top plate portion, and there is a possibility of external dust undesirably entering the case through the gap via the projected or exposed portion. However, by virtue of the mutually-overlapping edge regions of the top plate portions of the first and second case halves, i.e. because the inner top plate portion is located immediately beneath the other or outer top plate portion, dust having entered the case via the projected or exposed portion is effectively prevented, by the inner top plate portion, from being sent further inwardly beyond the inner top plate portion. Such arrangements of the present invention can prevent external dust from falling onto the moving member and movement guide section within the case, thereby achieving superior dust prevention. Because such dust prevention can be achieved without any extra component part, such as a blindfold plate, the present invention can be simple in construction and can reduce the necessary cost for the dust prevention.

For example, in a case where the movement guide section is in the form of a shaft extending in the direction of sliding movement of the moving member and the moving member is slidably supported by the shaft, the shaft can be easily positioned beneath the inner top plate portion, and the inner top plate portion can prevent dust etc. from getting into an area of sliding contact between the moving member and the shaft.

Preferably, at least one of the top plate portions of the first case half and the second case half, which is located inwardly of the other of the top plate portions, slants transversely across the direction of sliding movement of the moving member. Thus, dust etc. having entered the case via the projected or exposed portion can be not only effectively prevented by the inner top plate portion from being sent further inwardly but also caused to fall along the slanting top plate portion, so that the dust etc. will not accumulate on the inner top plate portion. The inner top plate portion may slant in any suitable direction. For example, if the inner top plate portion slants in such a manner that the above-mentioned edge region of the inner top plate portion is located lower than the other edge region, dust will fall along the slanting inner top plate portion onto the bottom surface of the case. If, on the other hand, the inner top plate portion slants in such a manner that the above-mentioned edge region of the inner top plate portion is located higher than the other edge region, dust will fall, along the slanting inner top plate portion and then along a side surface of the case, onto an area outside the case.

Preferably, at least one side plate portion of the first case half and at least one side plate portion of the second case half, corresponding to the at least one side plate portion of the first case half, have an engagement structure to provide engagement between the one side plate portions of the first case half and the second case half.

For example, the engagement structure comprises a recessed portion provided in the side plate portion of one of the first and second case halves and a projecting portion provided on other of the first and second case halves. The first and second case halves engage with each other by the projecting portion being fitted in the recessed portion; in this manner, the case is assembled. When the first and second case halves are to be joined with each other, the projecting portion provided on the top plate portion of the first or second case halve is caused to run over a wall surface area of the top plate portion of the second or first case half, against frictional resistance, until it reaches the recessed portion. Once the projecting portion reaches the recessed portion in the top plate portion of the second or first case half, it is firmly fitted into the recessed portion. Thus, when the projecting portion is to be disengaged from the recessed portion, it must be caused to run over the wall surface area of the top plate portion of the second or first case half, against frictional resistance, in a direction opposite the direction at the time of the joining; namely, the first and second case halves can never be easily disengaged from the recessed portion. As a consequence, the firm fitting engagement between the first and second case halves can be maintained reliably. Besides, no screw or other fastening member is required for the assemblage of the first and second case halves and operation for disassembling the first and second case halves can be simplified, so that maintenance can be effected with an enhanced operability.

Preferably, the top plate portion, slanting transversely across the direction of sliding movement, has raised portions formed on opposite end regions thereof spaced apart in the direction of sliding movement of the moving member. Thus, even when dust etc. accumulated on the inner top plate portion has been swept together in the direction of sliding movement of the moving member, the dust etc. can be effectively prevented, by the raised portions formed on the opposite end regions, from falling outside the case, so that the dust etc. falls only along the slanting top plate portion. As a consequence, the present invention can prevent even more effectively influences of dust etc. on the moving member and movement guide section within the case. The raised portions of the inner top plate portion may be held in abutting engagement against the lower surface of the outer top plate portion, in which case the first and second case halves can be appropriately positioned relative to each other in the vertical direction.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
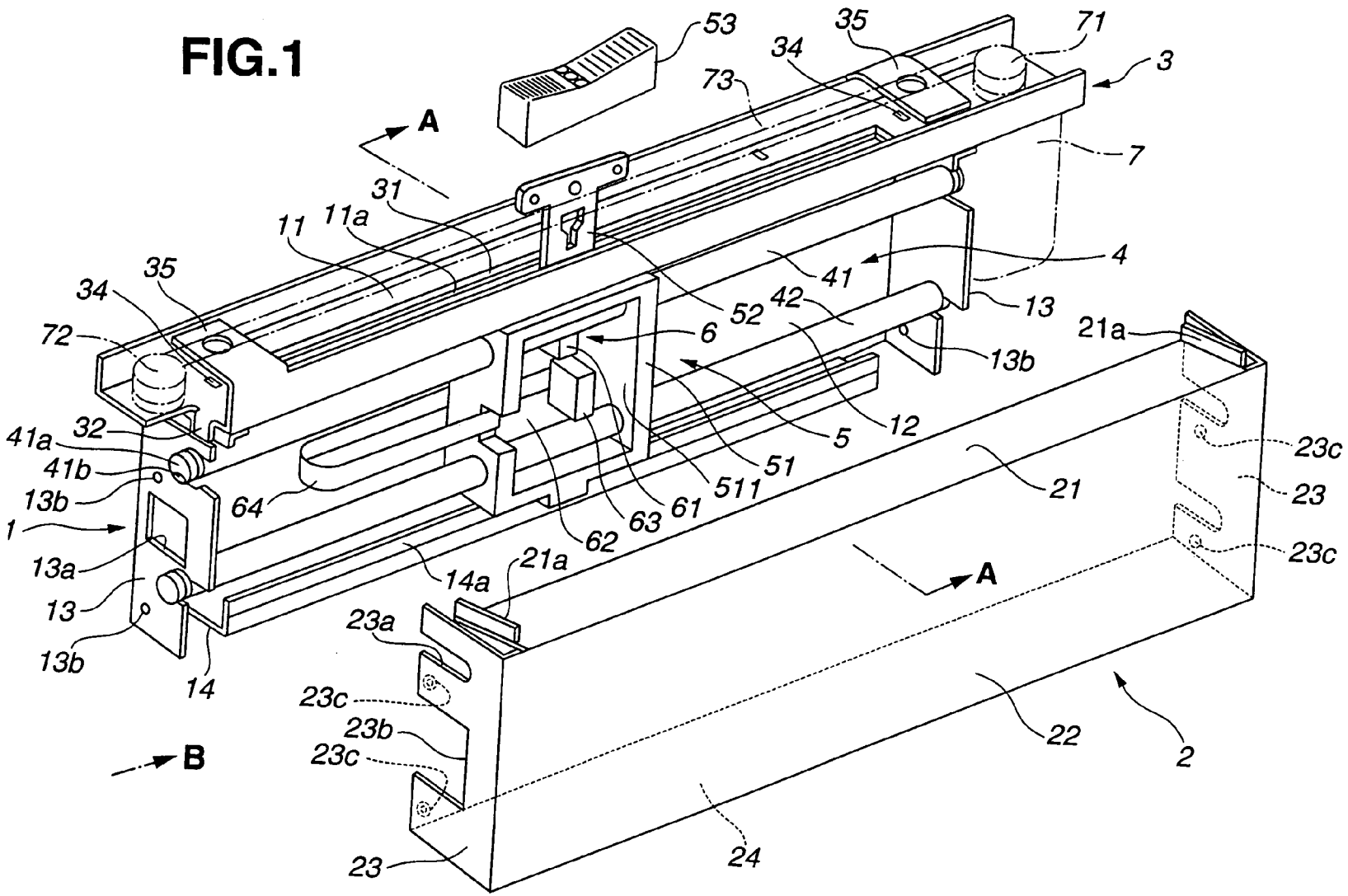
FIG. 1 is an exploded perspective view showing relevant sections of a sliding volume control device according to a first embodiment of the present invention.
Figure 2:
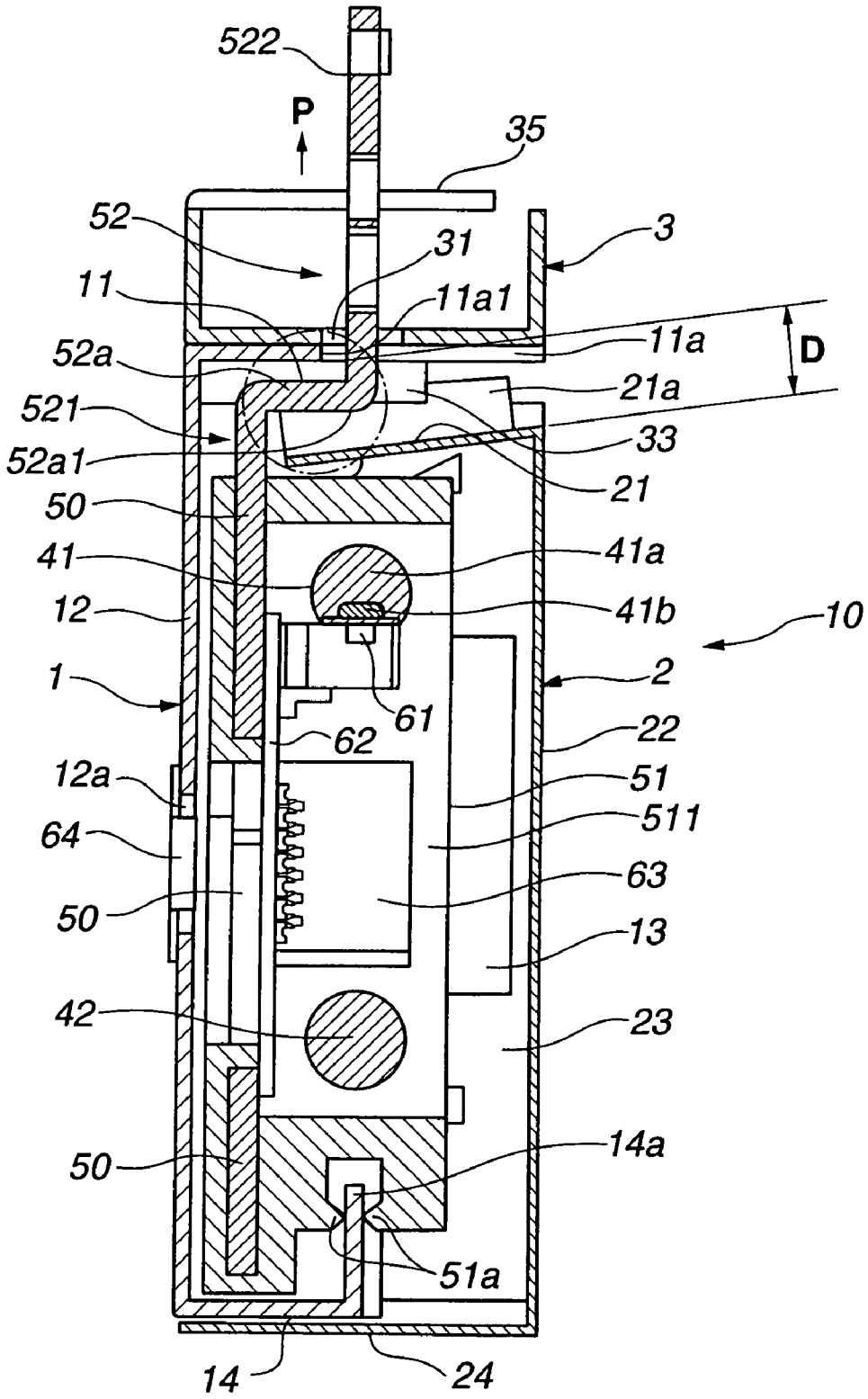
FIG. 2 is a view of the sliding volume control device taken along the A-A line of FIG. 1.
Figure 3:
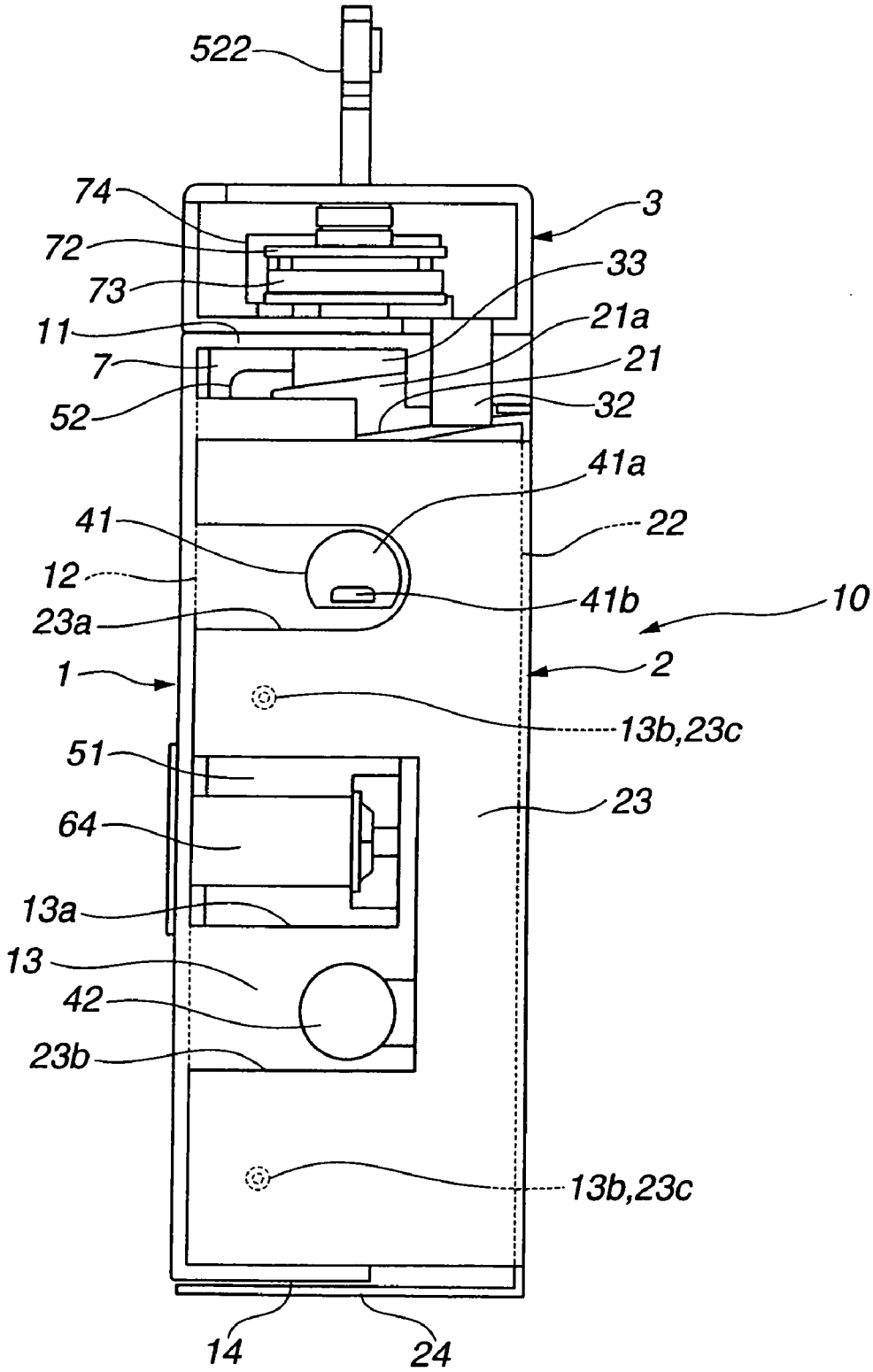
FIG. 3 is a view of the sliding volume control device taken in a direction of arrow B of FIG. 1.

FIG. 1 is an exploded perspective view showing relevant sections of a sliding volume control device constructed as a first embodiment of a sliding operating device of the present invention. FIG. 2 is a view of the sliding volume control device taken along the A-A line of FIG. 1, and FIG. 3 is a view of the sliding volume control device taken in the direction of arrow B. This sliding volume control device includes a frame 1 as a first case half, a cover 2 as a second case half, and a motor mounting member 3. The cover 2 and motor mounting member 3 may be formed by cutting and bending of a metal plate. The frame 1 and cover 2 are formed into a rectangular thin box shape. The motor mounting member 3 is formed into an elongated shape having a channel sectional shape.

The frame (first case half) 1, which is formed into a substantial box shape having an opening in one side thereof, has a top plate portion 11, case side surface portion 12, case end surface portions (i.e., side plate portions of the case half) 13, and a case bottom surface portion (i.e., another side plate portion of the case half) 14. The cover (second case half) 2, which is also formed into a substantial box shape having an opening in one side thereof, has a top plate portion 21, case side surface portion 22, case end surface portions (i.e., side plate portions of the case half) 23, and a case bottom surface portion (i.e., another side plate portion of the case half) 24. The cover 2 is fitted over the frame 1 with their respective openings opposed to each other, to thereby together constitute a case 10. Elongated recessed portion 11*a* is formed in the top plate portion 11 of the frame 1 adjacent to the cover 2, with regions near the case end surface portions left unrecessed. The motor mounting member 3 has an elongated recessed portion 31 having one side positioned in alignment with an end 11*a*1 (see FIG. 2) of the recessed portion 11*a* of the top plate portion 11. Further, the motor mounting member 3 has downwardly-bent outer positioning pieces 32 (FIGS. 1 and 3) and inner positioning pieces 33 (FIG. 2) formed near the opposite ends of the recessed portion 31. Although only the outer positioning piece 32 and inner positioning piece 33 formed near one end of the recessed portion 31 are shown in the figures, they are formed near the two ends of the recessed portion 31. The motor mounting member 3 is fitted over the frame 1 with the outer positioning pieces 32 abutted against the outer surfaces of the end surface portions 13 of the frame 1, and the frame 1 and motor mounting member 3 are integrally secured to each other through caulking in caulking portions 34 formed on the opposite ends of the recessed portion 31 of the motor mounting member 3. The inner positioning pieces 33 of the motor mounting member 3 function to accurately position the cover 2 as will be later described. Fastening plate portions 35 are formed on upper surface regions of the motor mounting member 3 near the opposite ends thereof, via which the sliding volume control device is mounted to a panel surface (reverse side) of a mixing console.

First and second guide shafts 41 and 42, extending parallel to each other along the length of the case side surface portion 12 (i.e., in the direction of sliding movement), are connected between and fixed to the opposite end surface portions 13 of the frame 1. The first guide shaft 41 is in the form of a magnetic scale, which comprises a substantially-rod-shaped shaft portion 41*a* formed by profile extraction of non-magnetic stainless steel and a magnetic member 41*b* embedded in a groove formed longitudinally in the shaft 41*a*, as seen in FIGS. 2 and 3. The second guide shaft 42 is a rod of stainless steel. The first and second guide shafts 41 and 42 together constitute a movement guide section 4, and a moving member (or gondola section) 51 is mounted on the first and second guide shafts 41 and 42 in such a manner that it is slidable along the length of the guide shafts 41 and 42. Guide rail 14*a* is provided on and along a longitudinal edge of the bottom surface 14 of the frame 1 closer to the cover 2 and projects upwardly in a vertical plane including the guide shafts 41 and 42. As shown in FIG. 2, sandwiching portions 51*a* formed beneath the moving member (or gondola section) 51 are located at opposite sides of the guide rail 14*a*. In this way, it is possible to prevent lateral rolling, about the first guide shaft 41, of the moving member 51 during the sliding movement. Although the second guide shaft 42 can function to prevent such lateral rolling of the moving member 51, only one of the second guide shaft 42 and the guide rail 14*a* may be provided.

The moving member (or gondola section) 51 is made of resin and has a sensor accommodating portion 511 in the form of a rectangular space. Magnetic sensors 61 and base plate 62 are accommodated in the sensor-accommodating portion 511. The magnetic sensors 61 are connected to a connector 63 on the base plate 62, and one end of a flat cable 64 is connected to the connector 63. The flat cable 64 is folded back 180° after being pulled out of the moving member (or gondola section) 51 and then pulled outside the case side surface portion 12 through a cable guide hole 12*a* (FIG. 2) formed in the side surface portion 12. The magnetic sensors 61 are energized via the flat cable 64, and detection signals output from the magnetic sensors 61 are sent to a not-shown circuit via the flat cable 64.

The cable guide hole 12*a* is formed in a middle, in the direction of sliding movement of the moving member (or gondola section) 51, of the case side surface portion 12. Length of a portion of the flat cable 64, extending from the cable guide hole 12*a* into the interior of the case 10, only need to be about half of an entire sliding range of the moving member 51. Further, because the flat cable 64 is folded back as noted above, it can be readily accommodated in the case. One of the case end surface portions (left case end surface portion) 13 of the frame 1 has an opening 13*a* for avoiding interference between the moving member 51 and part of the flat cable 64.

As shown in FIG. 2, a knob base substrate 50 is provided between a side surface of the moving member 51 and the above-mentioned base plate 62. The base plate 50 is formed by processing a metal plate, and part of the base plate 50 is formed as a knob-attached section (namely, operating section) 52 projecting above the top of the moving member 51. The knob-attached section (operating section) 52 has a crank portion (i.e., bent portion) 52*a* bent twice at a right angle in its proximal end portion 521 adjoining the top of the moving member 51. Sliding operator (i.e., knob operable by a human operator for desired sliding operation) 53 (FIG. 1) is provided on a free end portion 522 of the knob-attached section (operating section) 52.

The magnetic sensors 61 comprises an IC (i.e., Integrated Circuit) containing hall elements, and the like. The magnetic sensors 61 have their respective sensing surfaces facing the magnetic member 41*b* of the first guide shaft 41 with a slight gap (interval) interposed therebetween. The magnetic member 41*b* embedded in a lower surface portion of the first guide shaft 41*b* is a so-called "magnetic scale" having magnetic poles comprising N and S poles alternately arranged in its longitudinal direction at fine intervals (e.g., in 400 μm cycles). As the magnetic sensors 61 move relative to the magnetic member 41*b* with movement of the moving members 61, the magnetic sensors 61 output pulse signals corresponding to polarity changes between the N and S poles of the magnetic member 41*b*. Amount (or length) of sliding movement of the moving member 51 can be detected on the basis of the number of the pulse signals.

For example, the magnetic poles of the magnetic member 41*b* may be arranged in two rows (patterns) that are phase-shifted by (½) π in the longitudinal direction of the first guide shaft 41. Thus, the magnetic sensors 61 may be provided in correspondence with the two patterns and arranged at corresponding positions in the direction of sliding movement of the moving section 51. Thus, the magnetic sensors 61 output phase-shifted pulse signals (i.e., two-phase pulse trains), and thus, a moving (or sliding) direction of the moving member (gondola section) 51 along the guide shafts 41 and 42 can be identified on the basis of a positive/negative polarity of the phase shift. Alternatively, the two rows of the magnetic poles may be arranged in "NSNS, . . . " patterns with no phase shift therebetween, in which case detecting poles of the sensors, provided in correspondence with the patterns, may be arranged with a phase shift of (½) π. Further, because position information indicative of a position of the moving member 51 prior to movement is constantly stored by a not-shown control circuit etc., a position of the moving member 51 in the entire sliding volume control device, i.e. current operating position of the sliding operator 53 can be detected on the basis of the position information and the amount and direction of the sliding movement.

Namely, the moving member (gondola section) 51 and knob-attached section (operating section) 52 together constitute a moving operating-position setting section 5, and the first and second guide shafts 41 and 42 together constitute a movement support section (i.e., movement guide section) 4 for movably supporting the moving operating-position setting section 5. Further, the magnetic sensors 61 and the magnetic member 41*b* of the first guide shaft 41 together constitute an operating-position detection section 6.

Motor 7 is fixed to one end portion of the motor mounting member 3, a driving pulley 71 is mounted on a drive shaft of the motor 7, and a driven pulley 72 is mounted on another end portion of the motor mounting member 3. Timing belt 73 is wound at its opposite ends on the driving and driven pulleys 71 and 72. The knob-attached section (namely, operating section) 52 is fixed to a given position of the timing belt 73 by means of a fixation member 74 (FIG. 3). Note that the timing belt 73 is indicated in FIG. 1 in a one-dot-dash line. With the timing belt 73, the moving member (gondola section) 51 is driven to reciprocatively move along the first and second guide shafts 41 and 42 through forward/reverse rotation of the motor 7. Such movement of the moving member (gondola section) 51 is carried out, for example, in order to automatically set a position of the slid operator (knob) 53 so as to correspond to a given parameter when the sliding volume control device (fader) has been assigned to another function.

Next, detailed constructions of the frame 1 and cover 2 will be explained below. When the cover 2 is fitted over the frame 1, the case end surface portions 23 of the cover 2 are positioned in abutted relation to the outer surfaces of the corresponding end surface portions 13 of the frame 1, the case bottom surface portion 24 is positioned in abutted relation to the underside of the case bottom surface portion 14, and the top plate portion 21 is positioned between the top plate portion 11 of the frame 1 and the moving member (gondola section) 51. In the case end surface portions 23 of the cover 2, there are formed recessed portions 23*a* and 23*b* to avoid interference between the end surface portions 23 and the first and second guide shafts 41 and 42 mounted to the frame 1. Further, the lower recessed portions and 23*b* also function to avoid interference between the end surface portions 23 and the flat cable 64, in conjunction with the opening 13*a* formed in the frame 1.

Further, the top plate portion 21 of the cover 2 has a longitudinal length slightly smaller than the length of the case side surface portion 22, and raised portions 21*a* are formed on opposite end regions of the top plate portion 21. When the cover 2 is fitted over the frame 1, upper end regions of the case end surface portions 13 are fitted between upper end regions and the raised portions 21*a* of the cover 2, and the above-mentioned inner positioning pieces 33 are abutted against the inner surfaces of the raised portions 21*a* (see FIG. 2). In this way, the cover 2 is appropriately positioned relative to the frame 1 and motor mounting member 3. Further, upper and lower circular holes 13*b* are formed, as recessed portions, in the opposed end surface portions 13 of the frame 1, and spherical surface portions 23*c* are formed, as inwardly projecting portions, in positions of the cover 2 corresponding to the circular holes 13*b*. The spherical surface portions 23*c* of the cover 2 are formed by press working or otherwise.

Figure 5:
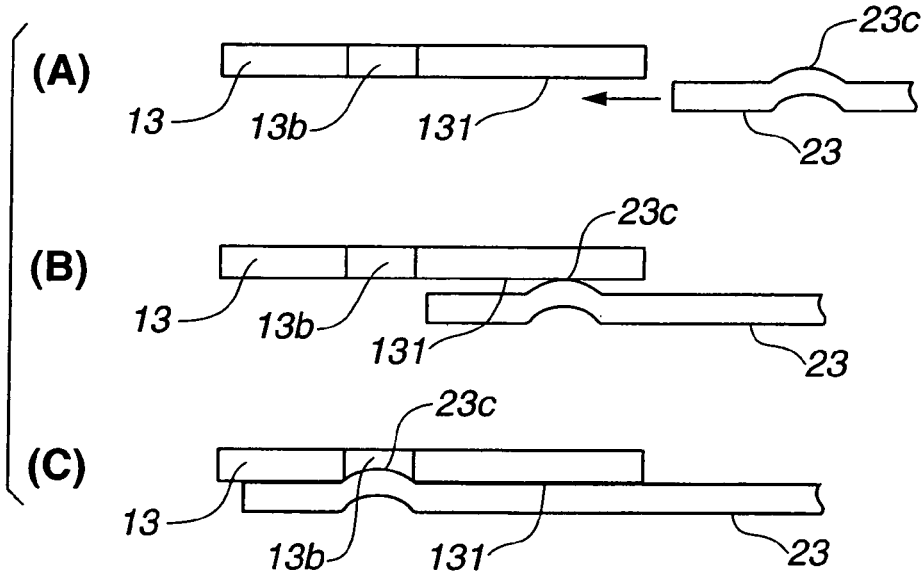
FIG. 5 is a view explanatory of behavior of recessed and projecting portions in the first embodiment of the present invention.

FIG. 5 is a view explanatory of behavior of the circular holes (recessed portions) 13*b* and spherical surface portions (projecting portions) 23*c*. As seen in (A) of FIG. 5, a region of each of the end surface portions 13, which is closer to the cover 2 than the circular hole 13*b*, is formed as a projection-side front portion 131. In fitting the cover 2 over the frame 1, each of the spherical surface portions 23*c* is caused to first run onto the corresponding front portion 131 as seen in (B) of FIG. 5 and then slide past (or run over) the front portion 131 into fitting engagement in the circular hole 13*b* as seen in (C) of FIG. 5. When the spherical surface portions 23*c* is sliding past the projection-side front portion 131, and when the spherical surface portions 23*c* is in fitting engagement in the hole 13*b*, their resiliency imparts a force that presses the end surface portions 13 and 23 against each other. In this way, the frame 1 and cover 2 are fittingly fixed to each other. The force fixing the frame 1 and cover 2 to each other is of such degree that the frame 1 and cover 2 can be detached from each other by a human operator applying a considerably small force.

As illustrated in FIG. 2, a gap D is formed between the top plate portion 11 of the frame 1 and the top plate portion 21 of the cover 2. Namely, in an upper surface area of the case 10, the top plate portion 11 of the frame (i.e., first case half) 1 and the top plate portion 21 of the cover (i.e., second case half) 2 are displaced (or spaced) from each other in a direction vertical to the upper surface of the case 10, so as to form the gap D for permitting entry of the knob-attached section (namely, operating section) 52. Thus, the crank portion (i.e., bent portion) 52*a* of the knob-attached section (namely, operating section) 52 is inserted in the gap D, and the free end portion 522 located upwardly of the crank portion 52*a* in the knob-attached section (operating section) 52 is exposed out of the case 10 through the frame's recessed portion 11*a* of the top plate portion 11 and recessed portion 31 of the motor mounting member 3. Further, the top plate portion 21 of the cover 2 is interposed between the crank portion 52*a* and the moving member 51 in such a manner as to not contact an end 52*a*1 of the crank portion 52*a* adjacent to the moving member 51. Further, the top plate portion 21 slants downwardly from the upper end of the case side surface portion 22 of the cover 2 toward the case side surface portion 12 of the frame 1. Namely, the top plate portion 21 slants from the top of the side surface portion 22 of the cover 2 toward one of side surfaces of the case 10 (in this case, case side surface portion 12) extending parallel to the direction of sliding movement of the gondola section 51 of the case 10. Further, as indicated by a one-dot-dash-line circle in FIG. 2, the top plate portion 11 of the frame 1 and the top plate portion 21 overlap with each other in the projecting direction (i.e., direction of arrow P) of the free end portion 522 of the knob-attached section (operating section) 52; that is, at least edge regions of the top plate portions 11 and 21 of the individual case halves 1 and 2 overlap with each other in the direction vertical to the upper surface of the case 10.

Figure 4:
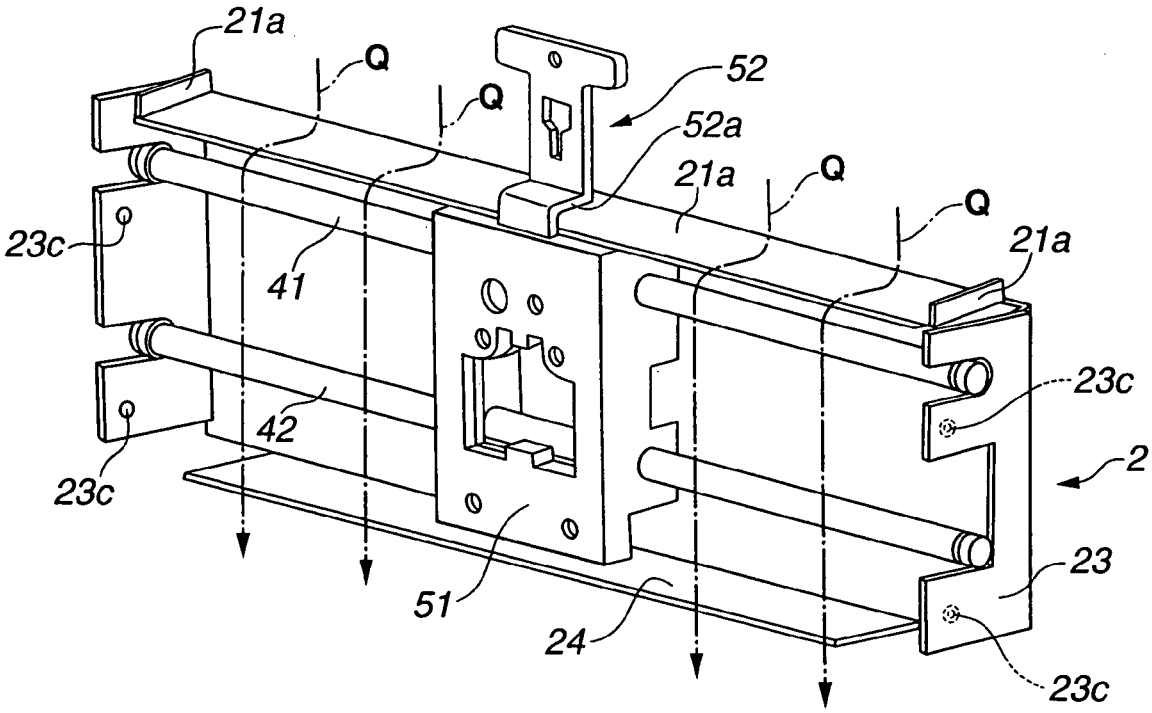
FIG. 4 is a view explanatory of behavior of a top plate portion of a cover employed in the first embodiment of the present invention.

FIG. 4 is a view explanatory of behavior of the top plate portion 21 of the cover 2. When dust enters through the recessed portion 31 of the motor mounting member 3 and recessed portion 11*a* of the top plate portion 11, the dust tends to move along the slanting cover's top plate portion 21 toward the side surface portion 12 of the frame 1 as indicated by arrow Q and then fall from the edge of the top plate portion 21 onto the case bottom surface portion 24. Therefore, the dust can be reliably prevented from accumulating on the guide shafts 41 and 42 and thus will not adversely influence the sliding movement of the gondola section 51. Further, even if dust etc. on the top plate portion 21 has been moved or swept to end regions of the top plate portion 21 by the crank portion 52*a* due to the sliding movement of the gondola section 51, the dust etc. can be prevented by the raised portions 21*a* from falling beyond the ends of the top plate portion 21, so that the dust etc. can be reliably prevented from accumulating on the guide shafts 41 and 42.

Further, because the first guide shaft 41, constituting a mechanism for detecting a position of the gondola section 51, is located adjacent to and immediately beneath the top plate portion 21 of the cover 2, almost no dust etc. will accumulate on the guide shaft 41, which can prevent dust etc. from adversely influencing the position detection accuracy. Furthermore, because influences, of dust etc., on the first guide shaft 41 can be minimized in the aforementioned manner, influences, of dust etc., on smoothness of the sliding movement of the first guide shaft 41 can be minimized, particularly in a case where the structure comprising the guide rail 14*a* and sandwiching portions 51*a* of the gondola section 51 as shown in FIG. 2 is employed with the lower or second guide shaft 42 omitted.

Figure 6:
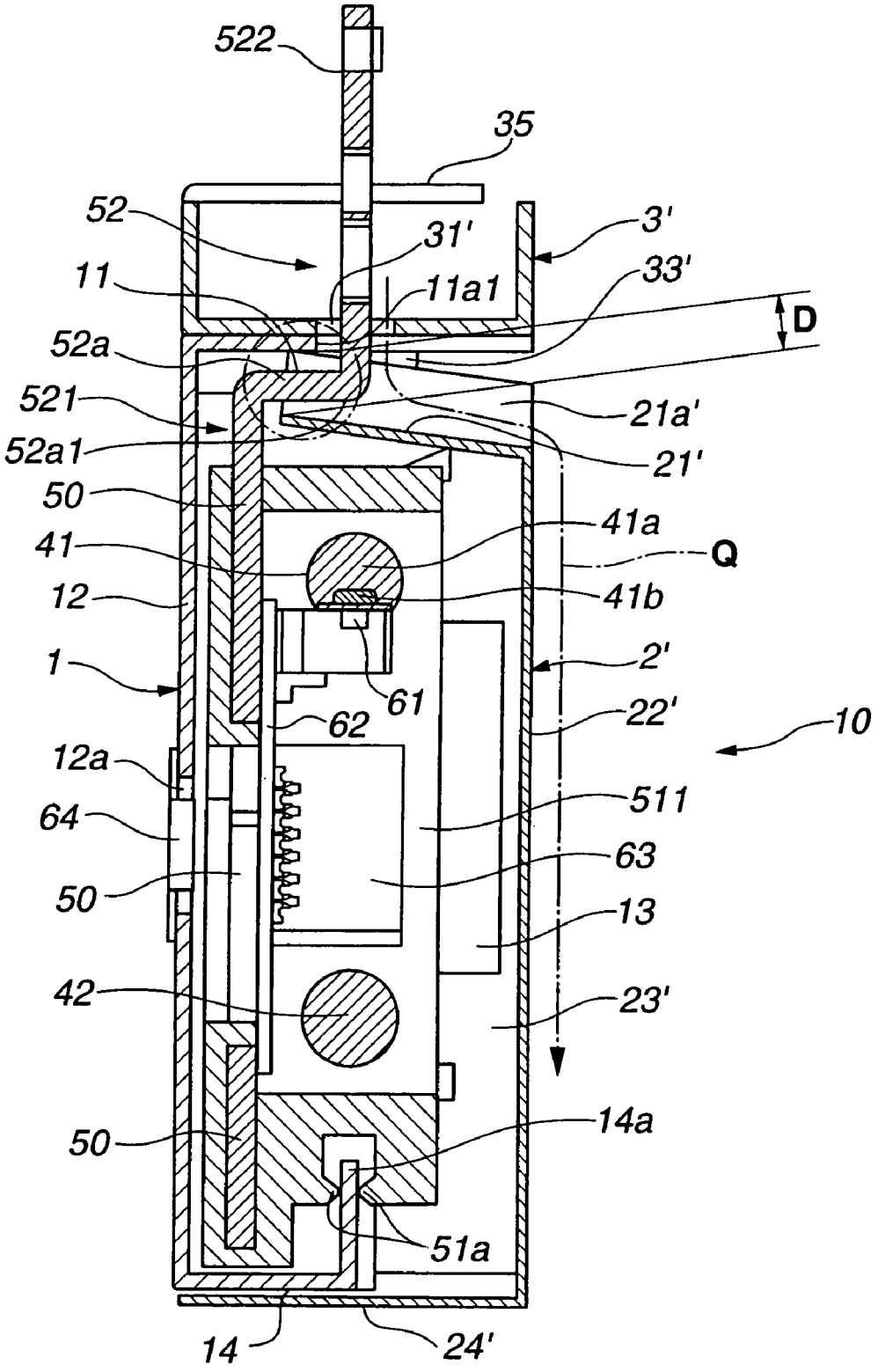
FIG. 6 is an exploded perspective view showing relevant sections of a sliding volume control device according to a second embodiment of the present invention.
Figure 7:
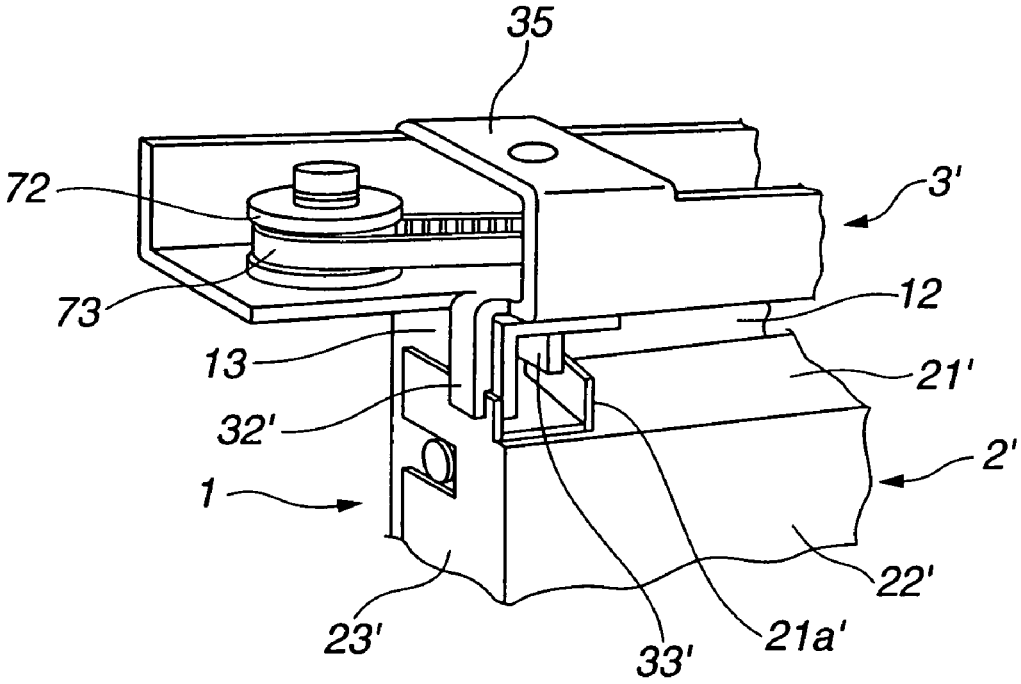
FIG. 7 is an enlarged perspective showing one end portion of the sliding volume control device shown in FIG. 6.

FIG. 6 is a sectional view, corresponding to the sectional view taken along the A-A line of FIG. 1, showing another sliding volume control device constructed as a second embodiment of the present invention. FIG. 7 is an enlarged perspective showing one end portion of the case employed in the sliding volume control device shown in FIG. 6. In these figures, elements similar to those in the first embodiment are indicated by the same reference characters with "'" marks and will not be described here in detail to avoid unnecessary duplication.

In the cover 2' of the second embodiment, as seen in FIG. 7, the top of the case end surface portion (i.e., side plate portion of the case half) 23' is located at generally the same height as the top of the raised portion 21*a*' of the top plate portion 21'. Slight gap is formed between the outer positioning piece 32' and the end surface portion (i.e., side plate portion of the case half) 13 of the frame 1. When the cover 2' is fitted over the frame 1, the top of the case end surface portion 23' of the cover 2' is fitted between the outer positioning piece 32' and the end surface portion 13. Further, the inner positioning piece 33' of the motor mounting member 13 is abutted against the outer surface of the raised portion 21*a*' of the cover 2'.

The top plate portion 21' slants downwardly from the upper end of the case side surface portion 12 of the frame 1 toward the case side surface portion 22' of the cover 2'. Namely, the top plate portion 21' in the second embodiment slants in an opposite direction to the top plate portion 21 employed in the first embodiment. However, the top plate portion 21' in the second embodiment is similar to the top plate portion 21 in the first embodiment in that the former slants toward one of the side surfaces (in this case, case side surface portion 22') extending parallel to the direction of sliding movement of the gondola section 51 of the case 10. Further, as in the first embodiment, the top plate portion 11 and the top plate portion 21' overlap with each other; that is, at least edge regions of the top plate portions 11 and 21' of the individual case halves 1' and 2' overlap with each other in the direction vertical to the upper surface of the case 10, as indicated by a one-dot-dash-line circle in FIG. 6.

According to the second embodiment, even when dust enters through the recessed portion 31 of the motor mounting member 3 and recessed portion 11*a* of the top plate portion 11, the dust tends to move along the slanting cover's top plate portion 21' beyond the side surface portion 22' of the cover 2 as indicated by arrow Q of FIG. 6 and fall from the edge of the top plate portion 21' onto an area outside the case 10. Therefore, even when dust enters, the dust can be prevented from accumulating within the case 10; thus, the second embodiment can avoid influences of dust more effectively than the first embodiment. Further, even if dust etc. on the top plate portion 21' has been moved or swept to end regions of the top plate portion 21' by the crank portion 52*a* due to the sliding movement of the gondola section 51, the dust etc. can be appropriately directed by the raised portions 21*a*' to fall onto an area outside the case 10.

In each of the above-described embodiments, the respective tops of the raised portions 21 or 21*a*' of the top plate portion 21 or 21' may be abutted against the underside (lower surface) of the frame's top plate portion 11, so that the cover 2 or 2' can be appropriately positioned in the vertical direction relative to the frame 1.

Figure 8A:
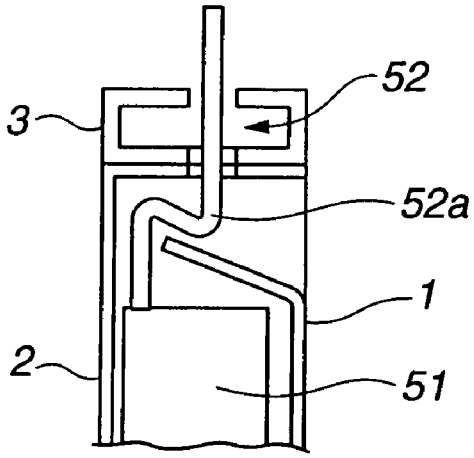
FIG. 8A is a view showing another example of a crank portion employed in each of the embodiments.
Figure 8B:
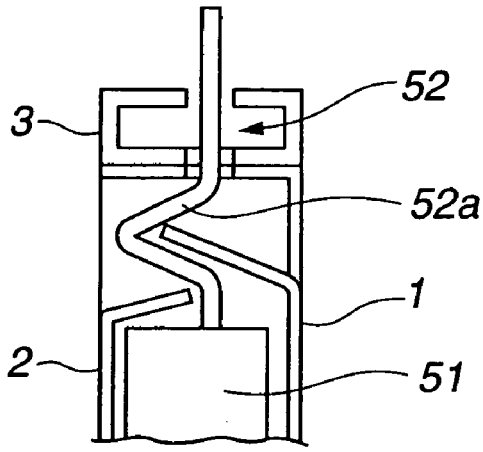
FIG. 8B is a view showing still another example of a crank portion employed in each of the embodiments.

Further, whereas, in each of the above-described embodiments, the crank portion (bent portion) 52*a* of the knob-attached (operating section) 52 has a crank shape bent twice at a right angle, the crank portion (bent portion) 52*a* may have a shape as shown in FIG. 8A or 8B. More specifically, FIG. 8A shows another example of the crank portion 52*a* which has a substantial Z shape, while FIG. 8B shows still another example of the crank portion 52*a* which has a "dogleg" shape. In either case, the crank portion 52*a* has such a bent shape as to be inserted in the gap D between the frame's top plate portion 11 and the cover's top plate portion 21.

Further, in each of the above-described embodiments, the circular holes (recessed portions) 13*b* are formed in the frame 1, while the spherical surface portions (projecting portions) 23*c* are formed on the cover 2. Conversely, such projecting portions may be formed on the frame 1, while such recessed portions may be formed in the cover 2.

Furthermore, whereas each of the above-described embodiments is constructed to detect a position of the gondola section by means of the operating-position detecting section comprising the magnetic sensors and magnetic scale member, the operating-position detecting section may be of an optical type or contact type rather than the magnetic type.

Furthermore, the knob-attached section (operating section) 52 is not limited to a one-part section (i.e., one-piece unit) as described above; for example, the knob-attached section 52 may comprise a component part provided on the proximal end portion 521, and a component part provided on the free end portion and detachably attached to the component part provided on the proximal end portion 521.

What is claimed is:

1. A sliding operating device comprising:

a case including first and second case halves, each having an opening in one side thereof, combined together with the openings opposed to each other;

a movement guide section accommodated within said case;

a moving member accommodated within said case and slidingly movable along said movement guide section; and an operating section connected to said moving member, said operating section having a proximal end portion connected to said moving member, a free end portion projecting outwardly from an upper surface of said case, and a bent portion bent between the proximal end portion and the free end portion, wherein, in the upper surface area of said case, a top plate portion of the first case half and a top plate portion of the second case half are displaced from each other, in a direction vertical to the upper surface of said case, to form a gap permitting entry of said operating section, and at least edge regions of the top plate portion of said first case half and the top plate portion of said second case half overlap with each other in the direction vertical to the upper surface of said case, and the bent portion of said operating section is bent so that the free end portion projects outwardly through the gap in overlapping edge regions of the top plate portions of said first case half and said second case half.

2. A sliding operating device as claimed in claim 1 wherein at least one of the top plate portions of said first case half and said second case half, which is located inwardly of other of the top plate portions, slants transversely across a direction of sliding movement of said moving member.

3. A sliding operating device as claimed in claim 2 wherein the top plate portion, slanting transversely across the direction of sliding movement, has raised portions formed on opposite end regions thereof spaced apart in the direction of sliding movement.

4. A sliding operating device as claimed in claim 1 which further comprises a detection section that detects a position of said moving member.

5. A sliding operating device as claimed in claim 1 wherein at least one side plate portion of said first case half and at least one side plate portion of said second case half, corresponding to the at least one side plate portion of said first case half, have an engagement structure to provide engagement between the one side plate portions of said first case half and said second case half.

6. A sliding operating device as claimed in claim 5 wherein said engagement structure comprises a recessed portion provided in the side plate portion of one of the first and second case halves and a projecting portion provided on other of the first and second case halves, and said first and second case halves engage with each other by the projecting portion being fitted in the recessed portion, whereby the case is assembled.

7. A sliding operating device as claimed in claim 1 wherein the operating section has a knob provided at the free end portion and suited for manual operation by a human operator, and the operating section is slidingly moved by the human operator manually operating the knob.

8. A sliding operating device as claimed in claim 1 which further comprises a motor that slidingly moves the operating section.

* * * * *